US012331498B2

(12) United States Patent
Tchong

(10) Patent No.: US 12,331,498 B2
(45) Date of Patent: Jun. 17, 2025

(54) COLD WATER SHOWER DEVICE

(71) Applicant: Martinho Tchong, Zuccoli (AU)

(72) Inventor: Martinho Tchong, Zuccoli (AU)

( * ) Notice: Subject to any disclaimer, the term of this patent is extended or adjusted under 35 U.S.C. 154(b) by 202 days.

(21) Appl. No.: 18/207,518

(22) Filed: Jun. 8, 2023

(65) Prior Publication Data

US 2024/0410144 A1 Dec. 12, 2024

(51) Int. Cl.

| | |
|---|---|
| ***E03C 1/04*** | (2006.01) |
| ***E03C 1/02*** | (2006.01) |
| ***E03C 1/044*** | (2006.01) |

(52) U.S. Cl.

CPC ..... *E03C 1/0408* (2013.01); *E03C 1/044* (2013.01); *E03C 2001/026* (2013.01)

(58) Field of Classification Search

CPC ..... E03C 1/044; A61F 7/0085; F25D 31/002; F25D 31/006

See application file for complete search history.

(56) References Cited

U.S. PATENT DOCUMENTS

| | | | | |
|---|---|---|---|---|
| 4,060,997 | A | 12/1977 | Shultz | |
| 5,501,077 | A | 3/1996 | Davis | |
| 5,862,669 | A | 1/1999 | Davis | |
| 10,753,071 | B2 * | 8/2020 | Doss | E03B 7/075 |
| 2012/0204591 | A1 | 8/2012 | Jarvis | |
| 2021/0148614 | A1 * | 5/2021 | Melink | F24D 17/0005 |
| 2021/0341230 | A1 | 11/2021 | Ludlaim | |

FOREIGN PATENT DOCUMENTS

| | | | |
|---|---|---|---|
| WO | WO-2021229236 A1 * | 11/2021 | A61F 7/00 |

* cited by examiner

*Primary Examiner* — Janie M Loeppke

(57) ABSTRACT

A cold water shower device includes a water storage tank which receives cool water from a water source. The water storage tank including a refrigeration unit to chill the cool water in the water storage tank. A master valve is integrated into a wall of a shower in the bathroom which receives hot water from the water heater and cool water from the water source. The master valve directs an adjustable mixture of the hot water and the cool water into a shower head. A cold water valve is integrated into the wall of the shower which receives the cold water from the water storage tank. The cold water valve can either mix the cold water with the mixture of hot water and cool water from the master valve or supply the cold water directly to the shower head.

9 Claims, 3 Drawing Sheets

COLD WATER SHOWER DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cold water devices and more particularly pertains to a new cold water device for facilitating a user to take a cold shower in a hot environment. The device includes a water storage tank that includes a refrigeration unit to chill water stored in the water storage tank. The device includes a master valve which mixes hot water and cool water from the fluid source to a shower head for bathing. Additionally, the device includes a cold water valve for routing the chilled water in the water storage tank to the shower head to facilitate a cold shower to be taken in a hot environment.

(2) Description of Related Art Including Information Disclosed Under 37 CFR 1.97 and 1.98

The prior art relates to cold water devices including a variety of water cooler devices that includes thermoelectric coolers for cooling water and an evaporative cooler and a passive water cooler that includes a series of heat exchangers. Additionally, the prior art discloses a control system for a water chiller that includes a heat exchanger and a pump. In no instance does the prior art discloses a residential plumbing system that includes a water storage tank, a refrigeration unit integrated into the water storage tank for chilling water in the water storage tank, a master valve for controlling a shower head and a cold water valve for routing the chilled water in the water storage tank to the shower head.

BRIEF SUMMARY OF THE INVENTION

An embodiment of the disclosure meets the needs presented above by generally comprising a water storage tank which receives cool water from a water source. The water storage tank including a refrigeration unit to chill the cool water in the water storage tank. A master valve is integrated into a wall of a shower in the bathroom which receives hot water from the water heater and cool water from the water source. The master valve directs an adjustable mixture of the hot water and the cool water into a shower head. A cold water valve is integrated into the wall of the shower which receives the cold water from the water storage tank. The cold water valve can either mix the cold water with the mixture of hot water and cool water from the master valve or supply the cold water directly to the shower head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
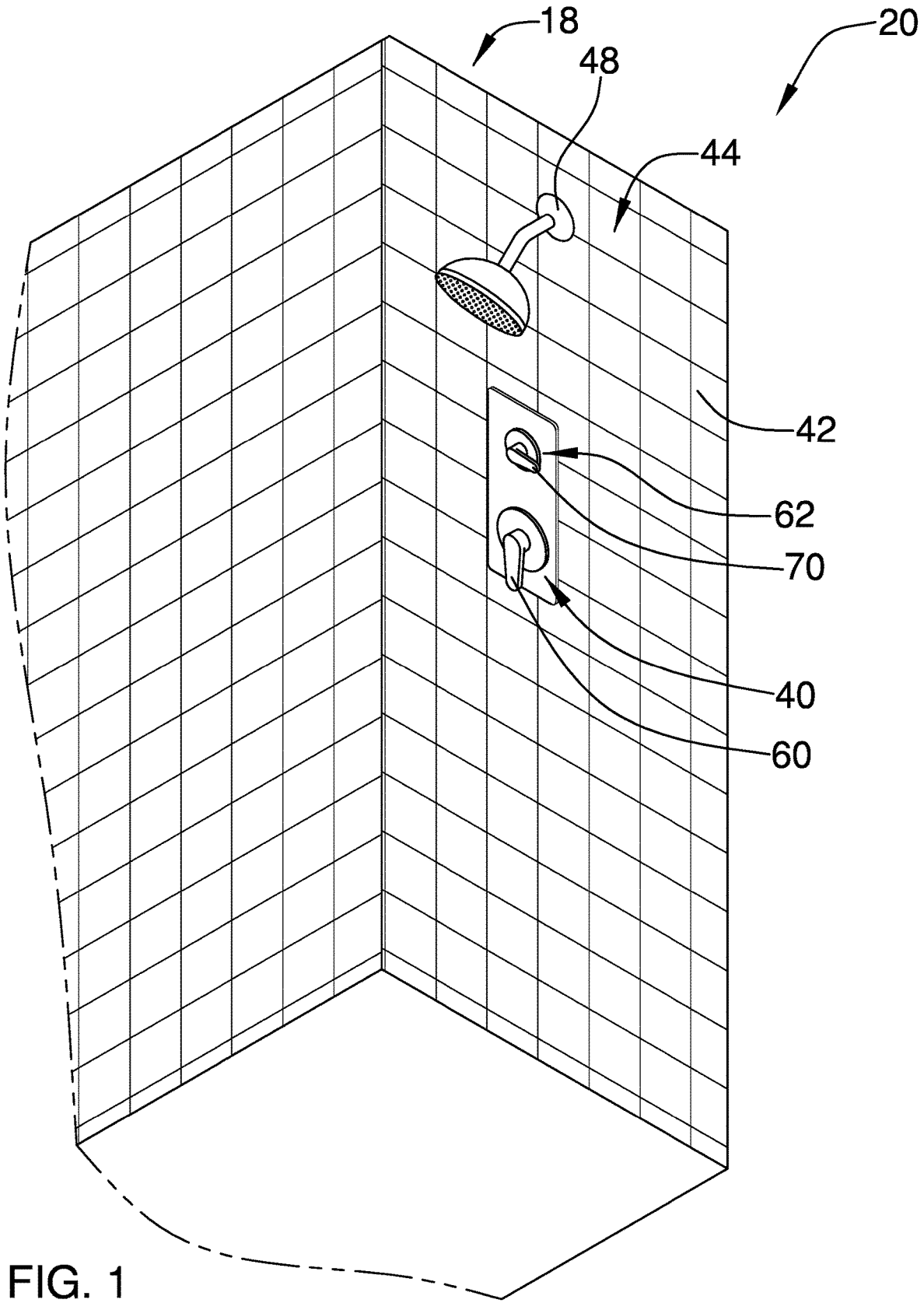
FIG. 1 is a perspective view of a bathroom of an embodiment of the disclosure.
Figure 2:
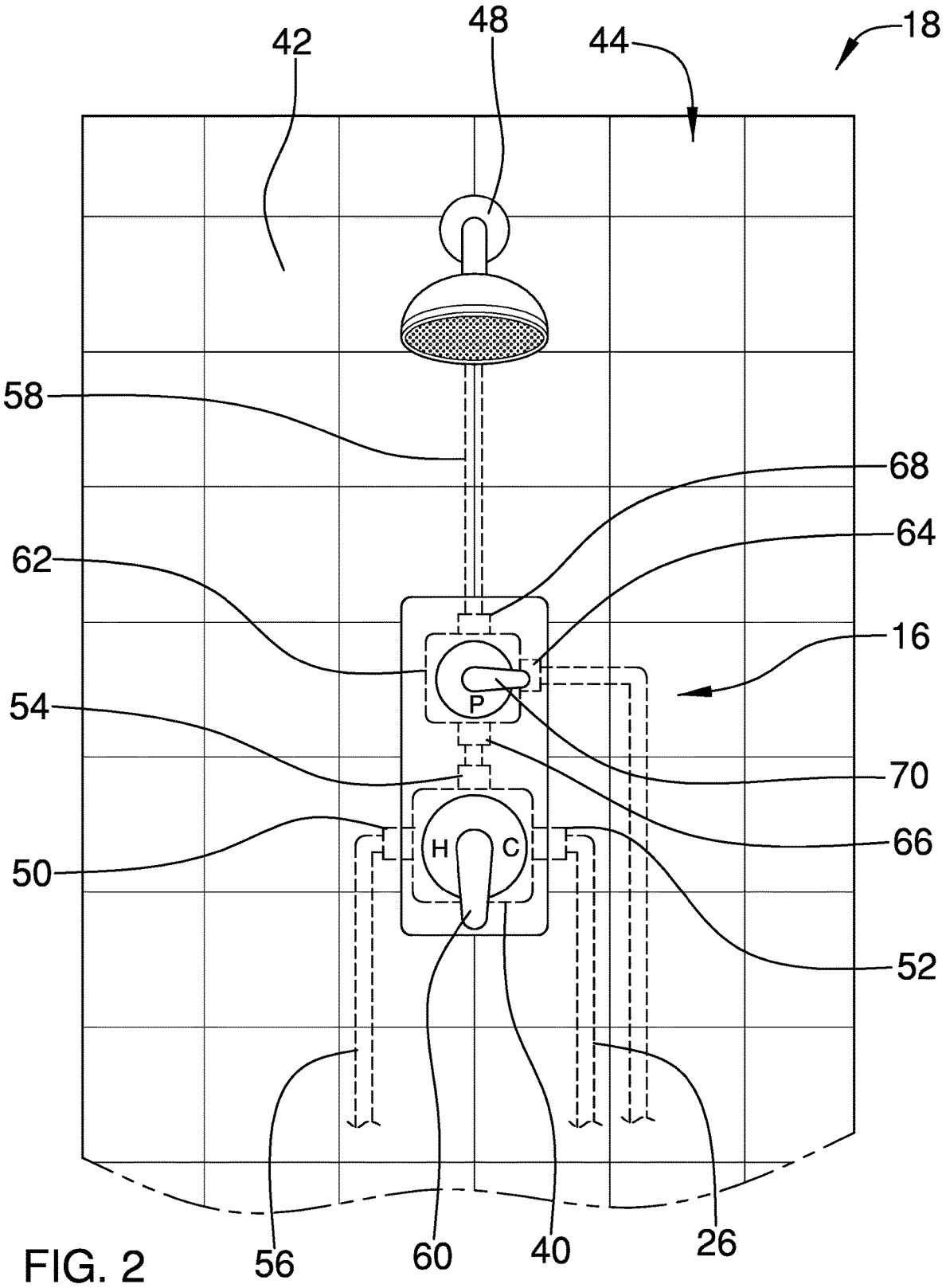
FIG. 2 is a perspective phantom view of a master valve and a cold water valve and a shower head of an embodiment of the disclosure.
Figure 3:
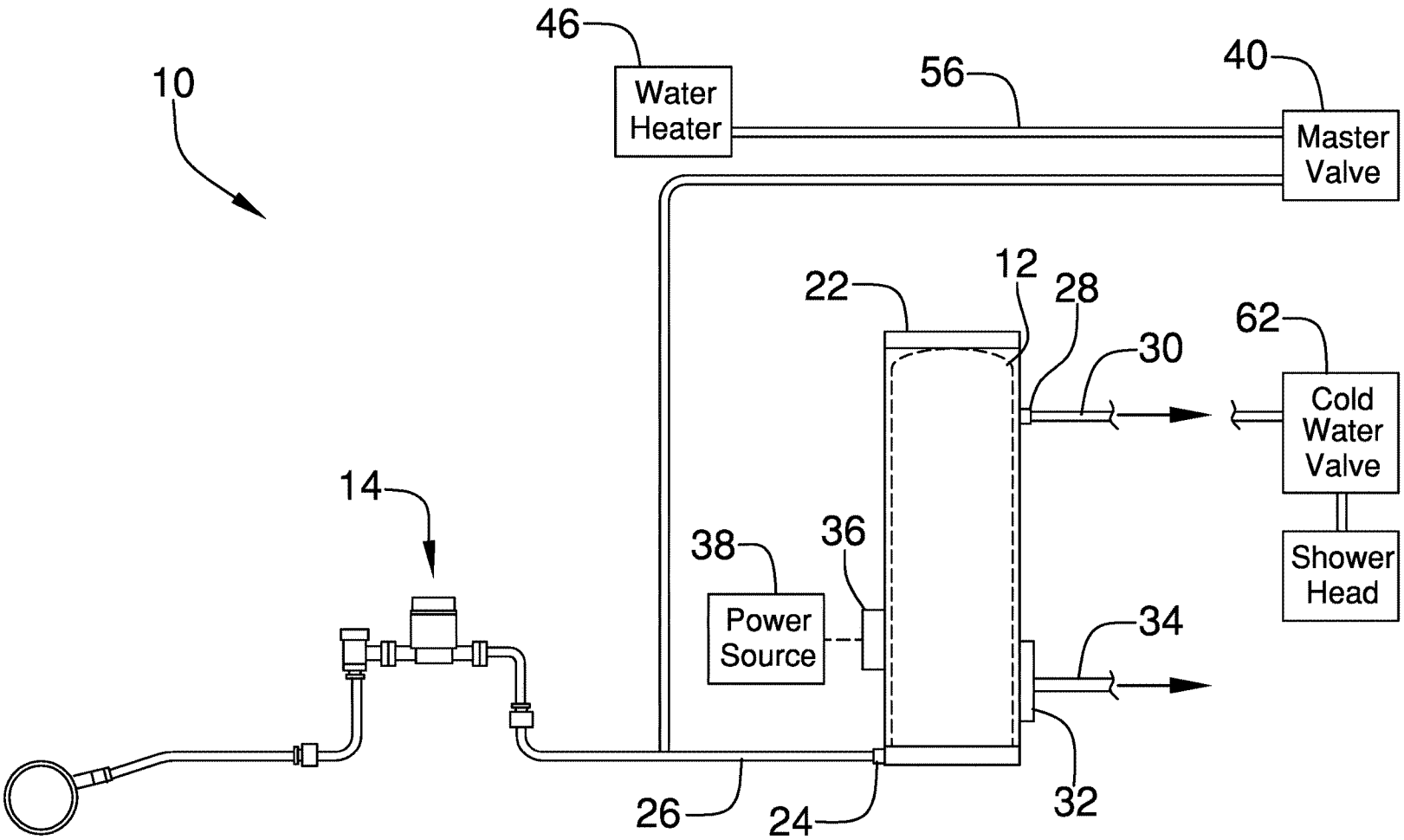
FIG. 3 is a perspective view of a cold water shower device according to an embodiment of the disclosure.

With reference now to the drawings, and in particular to FIGS. 1 through 3 thereof, a new cold water device embodying the principles and concepts of an embodiment of the disclosure and generally designated by the reference numeral 10 will be described.

As best illustrated in FIGS. 1 through 3, the cold water shower device 10 generally comprises a water storage tank 12 that is fluidly coupled to a water source 14 to receive cool water from the water source 14. The water storage tank 12 is integrated into the plumbing system 16 of a bathroom 18 in a building 20. The water source 14 may be a municipal water source that supplies drinking water to the building 20 in an urban environment or a well that services the building 20 in a rural environment or any other type of water source which serves to supply drinking water to the building 20. The water storage tank 12 includes a refrigeration unit 22 that is in thermal communication with the water storage tank 12 such that the refrigeration unit 22 cools the water storage tank 12. In this way the refrigeration unit 22 chills the cool water in the water storage tank 12 to a temperature ranging between approximately 8.0 degrees Celsius and 15.0 degrees Celsius.

The water storage tank 12 has an inlet 24 that is fluidly coupled to a cool water supply pipe 26 of the water source 14 and the water storage tank 12 has an outlet 28 is fluidly coupled to a cold water supply pipe 30. Additionally, the water storage tank 12 has a warm air exhaust 32 that is in fluid communication with the refrigeration unit 22 to exhaust warm air that results from the heat exchange between the refrigeration unit 22 and the water in the water storage tank 12. The warm air exhaust 32 includes an exhaust pipe 34 that is routed through the building 20 in which the waters storage tank 12 is integrated to direct the warm air outwardly from the building 20.

The refrigeration unit 22 includes a power connection 36 that is integrated into the water storage tank 12. Furthermore, the power connection 36 is electrically coupled to a power source 38 comprising an electrical system of the building 20. The refrigeration unit 22 may comprise a refrigeration unit of any conventional design which employs a compressor, a condenser, an evaporator, an expansion valve and a gaseous refrigerant. Additionally, the building 20 may be located in an area that is commonly exposed to extreme heat that generally maintains the water from the water source 14 at a temperature that is above approximately 20.0 degrees Celsius.

A master valve 40 is provided and the master valve 40 is integrated into a wall 42 of a shower 44 in the bathroom 18. The master valve 40 is in fluid communication with a water heater 46 of the building 20 to receive hot water from the water heater 46. Additionally, the master valve 40 is in fluid communication with the cool water supply pipe 26 of the water source 14 to receive cool water from the water source 14. The master valve 40 is in fluid communication with the shower head 48 in the shower 44 to direct an adjustable mixture of the hot water and the cool water into the shower head 48 for the purposes of bathing.

The master valve 40 has a hot water input 50 and a cool water input 52 and an output 54. The hot water input 50 is fluidly coupled to a hot water supply pipe 56 which is fluidly coupled to the water heater 46. The cool water input 52 is fluidly coupled to the cool water supply pipe 26 of the water source 14. Additionally, the output 54 of the master valve 40 is fluidly coupled to a supply pipe 58 of the shower head 48. The master valve 40 includes a handle 60 which extends through the wall 42 of the shower 44 thereby facilitating the handle 60 to be accessible. The handle 60 is positionable in an off position to inhibit water from flowing to the shower head 48. Conversely, the handle 60 is positionable at a variety of positions between a hot position and a cold position to mix the hot water and the cool water in a variety of ratios. The master valve 40 may be a shower valve of any conventional design that is commonly employed in residential plumbing systems.

A cold water valve 62 is provided and the cold water valve 62 is integrated into the wall of the shower 44. The cold water valve 62 is in fluid communication with the water storage tank 12 to receive the cold water from the water storage tank 12. Additionally, the cold water valve 62 is in fluid communication between the master valve 40 and the shower head 48. In this way the cold water valve 62 can either mix the cold water with the mixture of hot water and cool water from the master valve 40 or supply the cold water directly to the shower head 48.

The cold water valve 62 has a cold water input 64, a mixed water input 66 and an output 68. The cold water input 64 is fluidly coupled to the cold water supply pipe 30 that is fluidly coupled to the outlet 28 of the water storage tank 12. The mixed water input 66 is fluidly coupled to the output 54 of the master valve 40 and the output 68 of the cold water valve 62 is fluidly coupled to the supply pipe 58 of the shower head 48. The cold water valve 62 has a handle 70 extending through the wall 42 of the shower 44 thereby facilitating the handle 70 of the cold water valve 62 to be manipulated. The handle 70 of the cold water valve 62 is positionable in an off position to inhibit the cold water from the water storage tank 12 to flow to the supply pipe 58 of the shower head 48. Conversely, the handle 70 of the cold water valve 62 is positionable in an on position to facilitate the cold water from the water storage tank 12 to flow to the supply pipe 58 of the shower head 48. The cold water valve 62 is continuously actuated in a pass through condition having the output 54 of the master valve 40 being in continuous fluid communication with the supply pipe 58 of the shower head 48 regardless of the positioning of the handle 70 of the cold water valve 62. Finally, the cold water valve 62 may be a shower valve of any conventional design that is commonly employed in residential plumbing systems.

In use, the handle 60 on the master valve 40 is manipulated to deliver water to the shower head 48 at a preferred temperature for bathing. Furthermore, the water from the master valve 40 is delivered to the shower head 48 regardless of the positioning of the handle 70 on the cold water valve 62. The handle 70 on the cold water valve 62 can be manipulated into the open position to mix the cold water from the water storage tank 12 with the water delivered from the master valve 40. In this way the temperature of the water delivered from the master valve 40 can be cooled to a lower temperature than would otherwise be possible. Furthermore, the handle 70 on the cold water valve 62 can be manipulated into the open position when the master valve 40 is turned off. In this way the cold water from the water storage tank 12 can be delivered directly to the shower head 48. Thus, a person living in an environment that experiences extremely hot temperatures can enjoy the refreshing benefits of a cold shower that would otherwise be impossible.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cold water shower device for facilitating water to be cooled and stored for subsequent use by a user bathing in a hot environment, said device comprising:

a water storage tank being fluidly coupled to a water source wherein said water storage tank is configured to receive cool water from said water source, said water storage tank being integrated into a plumbing system of a bathroom in a building, said water storage tank including a refrigeration unit being in thermal communication with said water storage tank such that said refrigeration unit cools said water storage tank wherein said refrigeration unit is configured to chill the cool water in said water storage tank;

a master valve being integrated into a wall of a shower in said bathroom, said master valve being in fluid communication with a water heater of the building wherein said master valve is configured to receive hot water from said water heater, said master valve being in fluid communication with said water source wherein said master valve is configured to receive cool water from said water source, said master valve being in fluid communication with a shower head in said shower wherein said master valve is configured to direct an adjustable mixture of the hot water and the cool water into said shower head for the purposes of bathing; and a cold water valve being integrated into said wall of said shower, said cold water valve being in fluid communication with said water storage tank wherein said cold water valve is configured to receive the cold water from said water storage tank, said cold water valve being in fluid communication between said master valve and said shower head wherein said cold water valve is configured to either mix the cold water with the mixture of hot water and cool water from said master valve or supply the cold water directly to said shower head.

2. The device according to claim 1, wherein:

said water storage tank has an inlet being fluidly coupled to a supply pipe of said water source;

said water storage tank has an outlet being fluidly coupled to a cold water supply pipe;

said water storage tank has a warm air exhaust being in fluid communication with said refrigeration unit wherein said warm air exhaust is configured to exhaust warm air that results from the heat exchange between said refrigeration unit and the water in said water storage tank;

said warm air exhaust includes an exhaust pipe being routed through the building in which said waters storage tank is integrated wherein said exhaust pipe is configured to direct the warm air outwardly from the building; and said refrigeration unit includes a power connection being integrated into said water storage tank wherein said power connection is configured to be electrically coupled to a power source comprising an electrical system of the building.

3. The device according to claim 1, wherein:

said master valve has a hot water input and a cool water input and an output;

said hot water input is fluidly coupled to a hot water supply pipe which is fluidly coupled to said water heater;

said cool water input is fluidly coupled to a cool water supply pipe of said water source; and said output is fluidly coupled to a supply pipe of said shower head.

4. The device according to claim 3, wherein:

said master valve includes a handle extending through said wall of said shower thereby facilitating said handle to be accessible;

said handle is positionable in an off position wherein said master valve is configured to inhibit water from flowing to said shower head; and said handle being positionable at a variety of positions between a hot position and a cold position wherein said master valve is configured to mix the hot water and the cool water in a variety of ratios.

5. The device according to claim 3, wherein:

said water storage tank has an outlet being fluidly coupled to a cold water supply pipe;

said cold water valve has a cold water input, a mixed water input and an output;

said cold water input is fluidly coupled to said cold water supply pipe that is fluidly coupled to said outlet of said water storage tank;

said mixed water input is fluidly coupled to said output of said master valve; and said output of said cold water valve is fluidly coupled to said supply pipe of said shower head.

6. The device according to claim 5, wherein:

said cold water valve has a handle extending through said wall of said shower thereby facilitating said handle of said cold water valve to be manipulated;

said handle of said cold water valve is positionable in an off position wherein said cold water valve is configured to inhibit the cold water from said water storage tank to flow to said supply pipe of said shower head;

said handle of said cold water valve being positionable in an on position wherein said cold water valve is configured to facilitate the cold water from said water storage tank to flow to said supply pipe of said shower head.

7. The device according to claim 6, wherein said cold water valve is continuously actuated in a pass through condition having said output of said master valve being in continuous fluid communication with said supply pipe of said shower head regardless of the positioning of said handle of said cold water valve.

8. A cold water shower device for facilitating water to be cooled and stored for subsequent use by a user bathing in a hot environment, said device comprising:

a water storage tank being fluidly coupled to a water source wherein said water storage tank is configured to receive cool water from said water source, said water storage tank being integrated into the plumbing system of a bathroom in a building, said water storage tank including a refrigeration unit being in thermal communication with said water storage tank such that said refrigeration unit cools said water storage tank wherein said refrigeration unit is configured to chill the cool water in said water storage tank, said water storage tank having an inlet being fluidly coupled to a supply pipe of said water source, said water storage tank having an outlet being fluidly coupled to a cold water supply pipe, said water storage tank having a warm air exhaust being in fluid communication with said refrigeration unit wherein said warm air exhaust is configured to exhaust warm air that results from the heat exchange between said refrigeration unit and the water in said water storage tank, said warm air exhaust including an exhaust pipe being routed through the building in which said waters storage tank is integrated wherein said exhaust pipe is configured to direct the warm air outwardly from the building, said refrigeration unit including a power connection being integrated into said water storage tank wherein said power connection is configured to be electrically coupled to a power source comprising an electrical system of the building;

a master valve being integrated into a wall of a shower in said bathroom, said master valve being in fluid communication with a water heater of the building wherein said master valve is configured to receive hot water from said water heater, said master valve being in fluid communication with said cool water supply pipe of said water source wherein said master valve is configured to receive cool water from said water source, said master valve being in fluid communication with a shower head in said shower wherein said master valve is configured to direct an adjustable mixture of the hot water and the cool water into said shower head for the purposes of bathing, said master valve having a hot water input and a cool water input and an output, said hot water input being fluidly coupled to a hot water supply pipe which is fluidly coupled to said water heater, said cool water input being fluidly coupled to said cool water supply pipe of said water source, said output of said master valve being fluidly coupled to a supply pipe of said shower head, said master valve including a handle extending through said wall of said shower thereby facilitating said handle to be accessible, said handle being positionable in an off position wherein said master valve is configured to inhibit water from flowing to said shower head, said handle being positionable at a variety of positions between a hot position and a cold position wherein said master valve is configured to mix the hot water and the cool water in a variety of ratios; and a cold water valve being integrated into said wall of said shower, said cold water valve being in fluid communication with said water storage tank wherein said cold water valve is configured to receive the cold water from said water storage tank, said cold water valve being in fluid communication between said master valve and said shower head wherein said cold water valve is configured to either mix the cold water with the mixture of hot water and cool water from said master valve or supply the cold water directly to said shower head, said cold water valve having a cold water input, a mixed water input and an output, said cold water input being fluidly coupled to said cold water supply pipe that is fluidly coupled to said outlet of said water storage tank, said mixed water input being fluidly coupled to said output of said master valve, said output of said cold water valve being fluidly coupled to said supply pipe of said shower head, said cold water valve having a handle extending through said wall of said shower thereby facilitating said handle of said cold water valve to be manipulated, said handle of said cold water valve being positionable in an off position wherein said cold water valve is configured to inhibit the cold water from said water storage tank to flow to said supply pipe of said shower head, said handle of said cold water valve being positionable in an on position wherein said cold water valve is configured to facilitate the cold water from said water storage tank to flow to said supply pipe of said shower head, said cold water valve being continuously actuated in a pass through condition having said output of said master valve being in continuous fluid communication with said supply pipe of said shower head regardless of the positioning of said handle of said cold water valve.

9. A method of suppling cold water to a shower when the shower is located in a hot environment, the steps of the method comprising:

fluidly coupling an input pipe of water storage tank to a supply pipe of a water source such that a refrigeration unit of said water storage tank is configured to cool water stored in said water storage tank, said water storage tank having an output pipe;

integrating a master control valve into a wall of a shower, said master control valve having a hot water input and a cool water input and an output;

fluidly coupling said hot water input to a supply pipe of a water heater wherein said master control valve is configured to receive hot water from said water heater;

fluidly coupling said cool water input to said supply pipe of said water source wherein said master control valve is configured to receive cool water from said water source;

integrating a cold water valve into said wall of said shower, said cold water valve having a cold water input and a mixture input and an output;

fluidly coupling said cold water input to said output pipe of said water storage tank wherein said cold water valve is configured to receive the cold water from said water storage tank;

fluidly coupling said mixture input to said output of said master control valve wherein said cold water valve is configured to receive the mixture of hot water and cool water from said master control valve thereby routing the mixture of hot water and cool water from said master control valve to said shower head;

manipulating a handle of said master valve into an open position wherein said master valve is configured to route a predetermined mixture of hot water and cool water to said shower head; and manipulating a handle of said cold water valve into an open position regardless of whether said handle of said master valve is in said open position or a closed position wherein said cold water valve is configured to route the cold water from said water storage tank to said shower head.

* * * * *